United States Patent [19]

Fritz et al.

[11] Patent Number: 4,510,844

[45] Date of Patent: Apr. 16, 1985

[54] ELECTRONIC FIRING MECHANISM FOR WEAPONS

[75] Inventors: Raimund Fritz, Trossingen; Fritz Zeyher, Alpirsbach, both of Fed. Rep. of Germany

[73] Assignee: Heckler & Koch GmbH, Oberndorf, Fed. Rep. of Germany

[21] Appl. No.: 422,322

[22] Filed: Sep. 23, 1982

[30] Foreign Application Priority Data

Sep. 26, 1981 [DE] Fed. Rep. of Germany ..... 3138456

[51] Int. Cl.[3] ..... F41D 11/02

[52] U.S. Cl. ..... 89/135; 89/129.02; 89/142

[58] Field of Search ..... 42/84; 89/28 R, 135

[56] References Cited

U.S. PATENT DOCUMENTS

| | | | |
|---|---|---|---|
| 3,187,231 | 6/1965 | Schonherr . | |
| 3,576,471 | 4/1971 | Schumacher | 42/84 |
| 3,797,120 | 7/1973 | Stemme | 346/75 |
| 3,854,231 | 12/1974 | Broyles | 42/84 |
| 3,982,347 | 9/1976 | Brandl et al. | 89/28 R |

FOREIGN PATENT DOCUMENTS

| | | |
|---|---|---|
| 1932081 | 1/1971 | Fed. Rep. of Germany . |
| 2048743 | 5/1973 | Fed. Rep. of Germany . |
| 1440137 | 6/1976 | United Kingdom . |

*Primary Examiner*—Stephen C. Bentley
*Attorney, Agent, or Firm*—Murray Schaffer

[57] ABSTRACT

An electrical firing mechanism for hand guns and small caliber machine guns having a tension trigger which tightens a compression spring locading an impact member which when released strikes a piezo-voltage generator. The output of the generator leads to an electrical detonator. A firing mode selecting system, includes a lever which serves to engage a safety to block the trigger and to provide other firing modes such as burst and sustained fire. An additional source of electrical energy is provided in addition to the piezo-voltage generator, which can be connected with the detonator by way of the trigger, and the selecting system.

15 Claims, 8 Drawing Figures

ELECTRONIC FIRING MECHANISM FOR WEAPONS

BACKGROUND OF THE INVENTION

The present invention relates to an improved firing mechanism for weapons, especially handguns and small-caliber machine guns. The mechanism is provided with a mechanical trigger which tightens a pressure spring loading the impact member or a grounded piezo voltage generator which serves as a current source for firing singular charges. The outlet of the generator is connected to an electrical detonator igniting the propellant charge. At least one safety for locking the trigger and/or for interruption of the force flow from the pressure spring to the piezo voltage and/or current from the piezo voltage generator to the detonator.

Firing mechanisms of this type are familiar. They generally include a piezo voltage generator whose outlet is connected to an electrical detonator. To produce the detonator current impulse, a spring is tightened by the trigger (tension trigger) and is released toward the end of the trigger path, impelling a mass thus striking the piezo-electrical element of the piezo current generator which produces the desired current impulse which is carried directly or by way of a storage capacitor to the detonator. If the safety factor afforded by a tension trigger is to be disregarded, then the pressure spring can be activated independently of the trigger and the trigger used solely for tripping the tightened spring (DE-OS No. 20 48 743).

Firing mechanisms of this type, while adequate for single shot fire, are not satisfactory for bursts, i.e. the discharge of a preset number of rounds or for sustained fire whereby the weapon fires for as long as the trigger is held. To achieve this, it would be necessary to activate the piezo current generator by a back and forward moving breech block piece. This is not always possible in a simple fashion, since the breech block piece does not always move back to the same degree and because the detonation impulse is not required when the breech block piece is in reverse motion but only when it is in its forward terminal position (closed breech lock). Difficulties can also arise with the timing of the individual steps as well as with meeting the safety requirements for weapons of this type.

As compared to traditional weapons with mechanical impact detonation, the electrical detonation has the advantage of being made dust- and waterproof in a relatively simple fashion, which is of substantial importance for military weapons. It is also important that an electrical ignition is essentially freer of temperature influences, is lighter and more compact. Finally, electrically fired weapons can be produced which can fulfill practically any safety requirements or combinations of the same in the simplest fashion. However, the necessary condition for the use of an electrical firing mechanism for hand guns and small-caliber machine guns is that the firing modes "burst" and "sustained fire" must be achieved and securely maintained.

The object of the present invention is to provide a firing mechanism, particularly for hand guns and small-caliber machine guns, which will overcome the previously mentioned disadvantages and which will provide a construction and reliable functioning corresponding to the stated requirements.

SUMMARY OF THE INVENTION

The foregoing problems are solved by providing a firing mechanism of the above mentioned type wherein the detonation of the second and each successive round in the modes "burst" and "sustained fire" is created by an additional, preferably electrochemical, current source and that this current source be connected to the detonator by the trigger.

With the use of a piezo voltage generator for the detonation of the first round, the trigger system can be designed as a tension trigger. This affords, from the outset, a high degree of safety against accidental discharge even if no additional safety is provided. Through the use of a second, electrochemical current source, e.g. a battery, the firing of the successive rounds becomes independent of the production of an impact energy since this is supplied by the current source (battery). Through the combined use of a piezo voltage generator on the one hand and a battery on the other, the conditions mentioned in the objects set forth above can be fulfilled in an ideal fashion.

In one embodiment of the invention, a firing mode selection means is employed providing, in addition to the modes "safety" and "semi-automatic", the additional modes "burst" and "sustained fire". The mode selecting means includes a combination of safety selector and firing mode selector which simplifies its construction and enhances the reliability of operation as well as the safety in use, which is all the greater as the number of components requiring manipulation by the user is decreased.

In the foregoing embodiment, a mechanical round counter can be employed which, when set at the position "burst", will terminate the firing process after a previously set number of rounds has been fired. Such round counters are familiar in weapons applications. Also, the firing cadence can be present, in familiar fashion, through control of the operative forces and existing masses. In one preferred design, on the other hand, an electronic circuit, fed from the current source at the positions "burst" and "sustained fire", controls the detonation current as a factor of the cadence regulator and/or counter. The electronic counter of this circuit serves as a round counter, terminating the automatic fire after the present number of rounds has been reached by emitting an appropriate switching signal. Similarly, an impulse generator emitting repetitive firing impulses can be provided as a cadence regulator in order to adjust the firing cadence to any chosen setting (whereby the maximal firing cadence is, of course, limited by the mechanical properties of the breech block). The impulse generator which serves as the cadence regulator can be adjusted to various frequencies with minimal effort, whereby any firing cadences can be set starting from a peak value, down to the lower ranges. This had not been possible in the case of weapons with mechanical detonation or piezo electrical ignition activated by the breech lock.

Depending upon the design of the detonator and the layout of the additional current source, the current source can feed the detonator directly or by way of an interposed circuit. In one preferred design of the invention, on the other hand, and electronic circuit is employed having a voltage transformer for increasing the voltage of the current source.

The highly transformed voltage necessary for detonation is built up only after the release of the piezodetonated round or, in the event of semi-automatic firing, after operation of the trigger, through which means the safety of the weapon is substantially increased. In this way, with a commercially available, inexpensive current source of low voltage on the one hand and, with the piezo voltage detonator (high ohmic high voltage generator) on the other hand the same detonator can be activated.

In one embodiment, the additional current source can be connected with the electronic circuit and the detonator by a switch-operated trigger. This has the advantage that in the case of a mechanically blocked trigger, if the safety selector is in the position "safety", a shot cannot be fired accidentally. In addition, there is also the advantage that the current is always securely separated from the electronic circuit and the detonator since the trigger, when the weapon is not in use, always returns to its initial position in which the switch is opened. This assures that the current source is not drained when the trigger is not in use and does not need to be replaced for the duration of its storage capacity. The concern of having to change the current source under combat conditions can be eliminated, i.e., it can be constructively fully sealed, without any problems, and be stored safely in the weapon itself.

In another embodiment, a mechanical switch is built into the breech block and connected with the electronic circuit to produce a control or pilot signal when the breech block is closed. This switch assures through its signal that a round can be fired only when the breech block is fully closed and thus without danger to the user. The switch can be constructed as a familiar contactless switch (proximity switch) or as a contact switch such as a "micro-switch". In the latter instance it can also be placed directly in the conductor line to the detonator and thus prevent the discharge of a round even if set for "semi-automatic", when the breech block is not completely closed.

There are also instances as for "sniper" fire which, on the one hand, a tension trigger safety, must be used and cannot be abandoned and yet, on the other hand, there must exist the possibility of discharging a single round without great trigger resistance, thus attaining high precision aimed fire. This can, for example, be attained by having the pressure spring activated by some other component than the trigger. This, however, involves additional mechanical expense. With the present invention, such a further firing mode "sniper", can be set, in which the ignition energy for the first round can be drawn from the current source. In this mode of operation, the round can be fired without or with only minimal activation of the pressure spring or movement of the trigger. With the use of the additional current source for this firing mode it is possible to achieve a hair trigger for particularly precise firing without the mechanical expense normally required for this purpose. The only requirement is that the means for activating the piezo voltage generator not be released by the trigger before the end of the tension path. The trigger-controlled switch means which controls the round during this mode of firing is also used in other firing modes, e.g. sustained fire, without, however, causing the firing of a round exactly as in this instance.

In still another design of the invention the trigger can be moved in the usual operational modes and can be pivoted into the firing mode "sniper" whereby a switch to the firing mode "sniper" ensues through the mechanical shifting of the trigger movement. In so doing, it is preferable to undertake this mechanical transposition of the trigger movement from pivotal to sliding or vice versa movement by means of the firing mode selector which, in any case, comprises a mechanical operational component, for example, an adjustment knob or an adjusting lever. In a further design, the electronic circuit is so laid out that when set at the firing mode "sniper", only one shot can be discharged with each activation of the trigger. This can be achieved, for example, by setting the round counter at "1" in this firng mode. Or a flip-flop can be provided which can be tipped into the one position by the action of the trigger or by the signal of the switch built into the breech block which can be tipped into the other position.

Further details and refinements of the present invention are set forth in the following description and illustrated in the attached drawing.

DESCRIPTION OF THE INVENTION

The Drawings show in schematic and amplified form only so much of the weapon and its mechanical and electrical details as are necessary for a full understanding of the invention. Those components not shown are conventional and will be well known to those skilled in the art.

Figure 1:
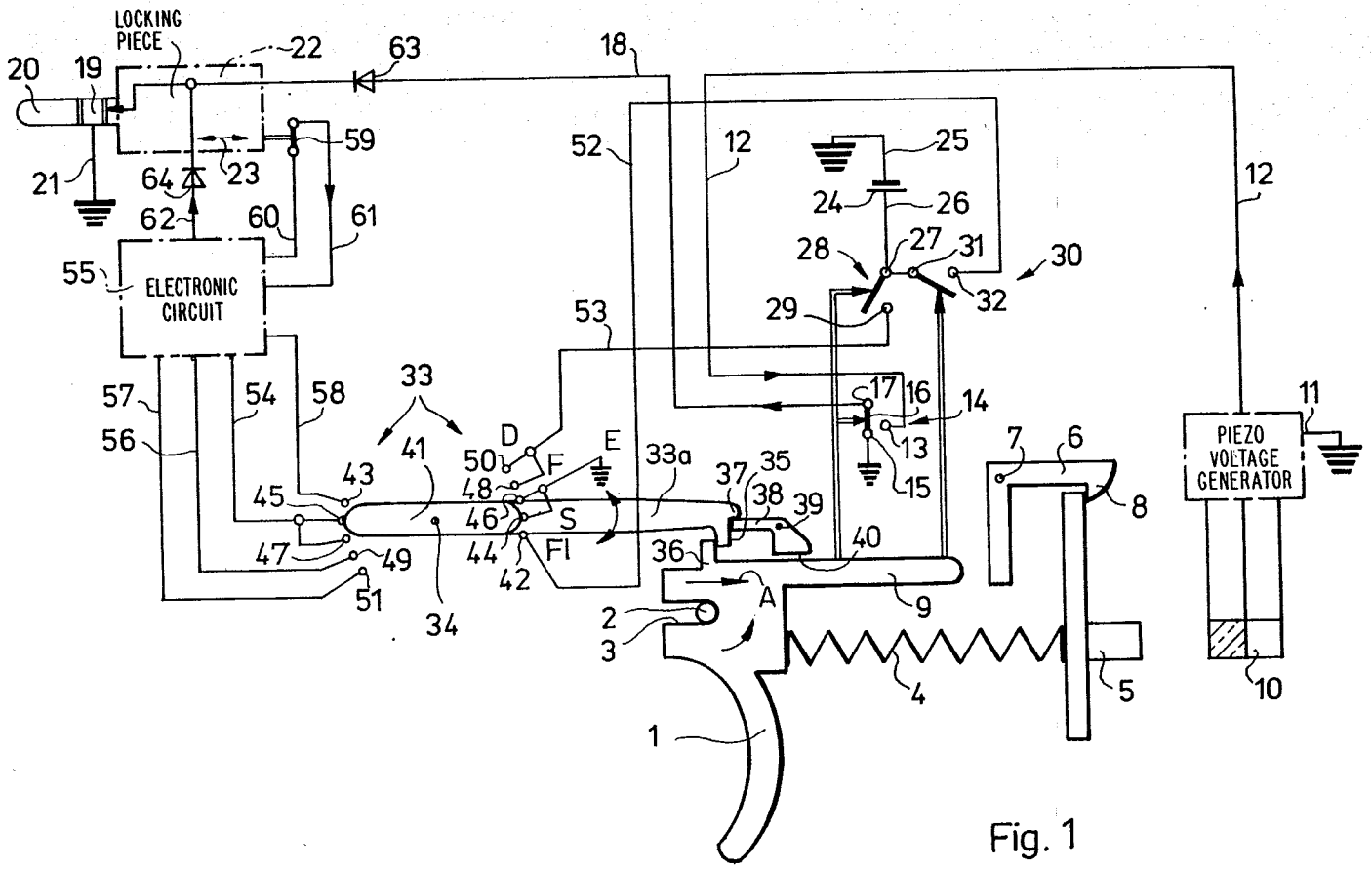
FIG. 1 is a schematic functional diagram of a trigger mechanism of the present invention.

Turning to FIG. 1, a trigger 1 is mounted so as to be capable of either being swiveled around a pin 2 or of being adjustably moved longitudinally in the direction of arrow A by providing it with an oblong hole 3. The trigger 1, is biased under the pressure of a compression spring 4 so that its rest position is defined by the engagement of the pin 2 with the bottom of the oblong hole 3. The spring 4, serves also as an energy accumulator and is supported at its other end against an impact piece 5 which is guided in the direction of force of the compression spring 4 and which is arrested by a right angle crank lever 6 which is be pivoted about an axis 7. The end of the lever 6 is provided with a hook 8 which latchingly engages the impact piece 5. The lever 6 is pivoted on actuation of the trigger 1 by engagement with a projection 9 formed on the trigger 1. The projection 9 comes into contact with the depending arm of the lever 6 once the trigger 1 has been shifted in the longitudinal direction of the oblong hole 3 against the pressure of the compression spring 4.

A primary source of ignition energy for the normal firing of the first and singular shots is obtained through a piezo voltage generator 10 arranged in the path of motion of the impact piece 5. The generator is grounded by a connection 11 and is connected via a lead 12 to a fixed contact 13 of a switch 14. The switch 14 has a fixed grounded contact 15, and a movable spring contact 16, pivoted at a central fixed connection 17. The movable contact 16 is, thus, positionable alternately between contacts 13 and 15. A lead 18, the central contact 17 extends to one pole surface of an electrical detonator 19 which is part of a round 20 located in the barrel of the weapon (which is not depicted). The other pole of the electrical detonator 19 is grounded by way of the cartridge case or, in the instance of caseless cartridges, an additional lead 21. The connection of the detonation lead 18 with the electrical detonator 19 is formed by way of the breech block piece 22 though an electrically insulated contact pin (not shown) in lieu of an impact bolt.

In such weapons the breech block piece 22 is, as is familiar, a recoil member movable in the direction of a double arrow 23. A switch formed as a normally OFF contact 59 is provided. The contact 59 is closed when the breech block piece 22 is in a firing position and is opened when the breech block piece is not, or not completely, in the firing position.

Additional firing modes are obtained through a second or additional source of current, in the form of a battery 24 connected, on the one hand, with the ground by a lead 25 and, on the other hand, by a lead 26 to a pair of central poles 27 and 31 of switches 28 and 30 respectively. The central pole 27 is provided with a blade movable into and out of engagement with a contact point 29 closing the switch, while pole 31 has a contact blade movable into and out of engagement with contact point 32 closing the switch.

The blades of each of switches 14, 28 and 30 are all capable of being mechanically switched by the trigger 1 which is provided with projecting arms or the like attached to or actuated by the projection 9 to engage the blades. The layout is so arranged that the switches 14 and 28 can be operated when the trigger is shifted in the longitudinal direction (arrow A) of the oblong hole 3, i.e. in the direction to compress the compression spring 4, but not when the trigger is swiveled around the pin 2. On the other hand, the switch 30 can be operated in the event the trigger is swiveled around pin 2, but cannot be operated when the trigger is moved longitudinally.

A firing mode selection system if provided. The system includes a selector, generally depicted by the numeral 33, which serves to allow the setting by the shooter of the various operating modes. The selector is capable of being set at five different positions: "sniper" (Fl), "safety" (S), "semi-automatic" (E), "burst" (F) NS "sustained fire" (D). In the setting "sniper" the trigger 1 can be very easily operated, as in the case of sniper rifles, having a hair trigger causing the firing of a single shot without activation of the piezo voltage generator. It is thereby possible to fire a shot with high precision because the trigger pressure will be minimal. In the position "safety" no shot can be fired. In the position "semi-automatic" a single round is fired when the trigger is operated, and the release and renewed pulling of the trigger 1 is required to fire an additional round. In the position "burst" a selected sequence of rounds, such as three shots, is fired upon operation of the trigger 1, the number of rounds being fixed by a round counter. After the release of the trigger 1 and its renewed operation a further burst can be fired. In the position "sustained fire" the weapon continues to fire for as long as the trigger is held and until the trigger is released (or the magazine is empty).

The firing mode selector 33 is interposed between the battery 24 and switch 28, 30 and an electronic circuit 55 which is part of the firing mode selecting system. The firing mode selector 33 operates in part mechanically and in part as an electrical switch. Mechanically the selector 33 comprises a straight lever **33*a*, pivoted about an axis 34, having a depending hook at its rear end 35. The lever 33*a* is atached to a shaft (not shown) which is manually pivoted around the axis 34, to be placed through the mode position Fl, S, F and D. The hooked end 35 catches an upward tab 36 extending from the upper edge of the trigger 1 when placed in the positions "safety" and "sniper". By this means the trigger 1 is mechanically barred against sliding in the longitudinal direction of the oblong hole 3. A nose 37 extends from the rear end 35 of the lever 33*a* coming to the rest on an arm of a small bell crank 38, pivotable about an axle pin 39. When the firing mode selector lever 33*a* is moved to the position "sniper", the bell crank 38 is moved so that its lower guide surface 40 is inclined as to be spaced from the upper edge of the projection 9 of the trigger 1. The trigger 1 can now be pivoted around the pin 2, (without sliding in the longitudinal direction, since the end of the hook lever 35 engages the tab 36). In the position "safety" (S) and "sniper" (Fl) the hooked end 35 engages with the projections 36 preventing sliding depression of the trigger. In the other firing modes, "semi-automatic" (E), "burst" (F) and "sustained fire" (D) the hooked end 35 does not engage the projection 36**, thus allowing the trigger to move longitudinally.

To operate as an electrical switch the front portion 41 of the switch lever **33*a* is formed as a conductive switch blade, and is adapted to contact at its front end a series of contact points 43, 45, 47, 49 and 51 while simultaneously its rear end 33 is adapted to contact a series of contact points 42, 44, 46, 48 and 50. The contact points are arranged so that in the position "sniper" (Fl) the contacts 42 and 43 are connected; in the position "safety" (S) contacts 44 and 45 are connected; in the position "semi-automatic" (E) contacts 46 and 47 are connected; in the position "burst" (F) contacts 48 and 49 are connected; and, in the position "sustained fire" (D) contacts 50 and 51 are connected. The contacts 44 and 46 are connected with each other and are both grounded. The contact 42 is connected by way of a lead 52 with the operating contact point 32 of the switch 30, while the contacts 48 and 50 are connected with each other and, by way of a lead 53, with the operating contact point 29 of the switch 28. The contacts 45 and 47 are similarly connected with each other and, by way of a lead 54, with an electronic circuit 55. In addition, the contacts 49, 51 and 43 are connected by way of leads 56, 57 and 58 respectively with the electronic switch 55. Further, the two connections of the OFF contact 59 are connected with the electronic switch 55 by way of leads 60 and 61. Finally, a lead 62 from the electronic switch 55 to the detonation lead 18. Diodes 63 and 64 are connected into the leads 18 and 62 respectively insuring unidirection flow through the appropriate sections of the electronic switch 55**.

Figure 2:
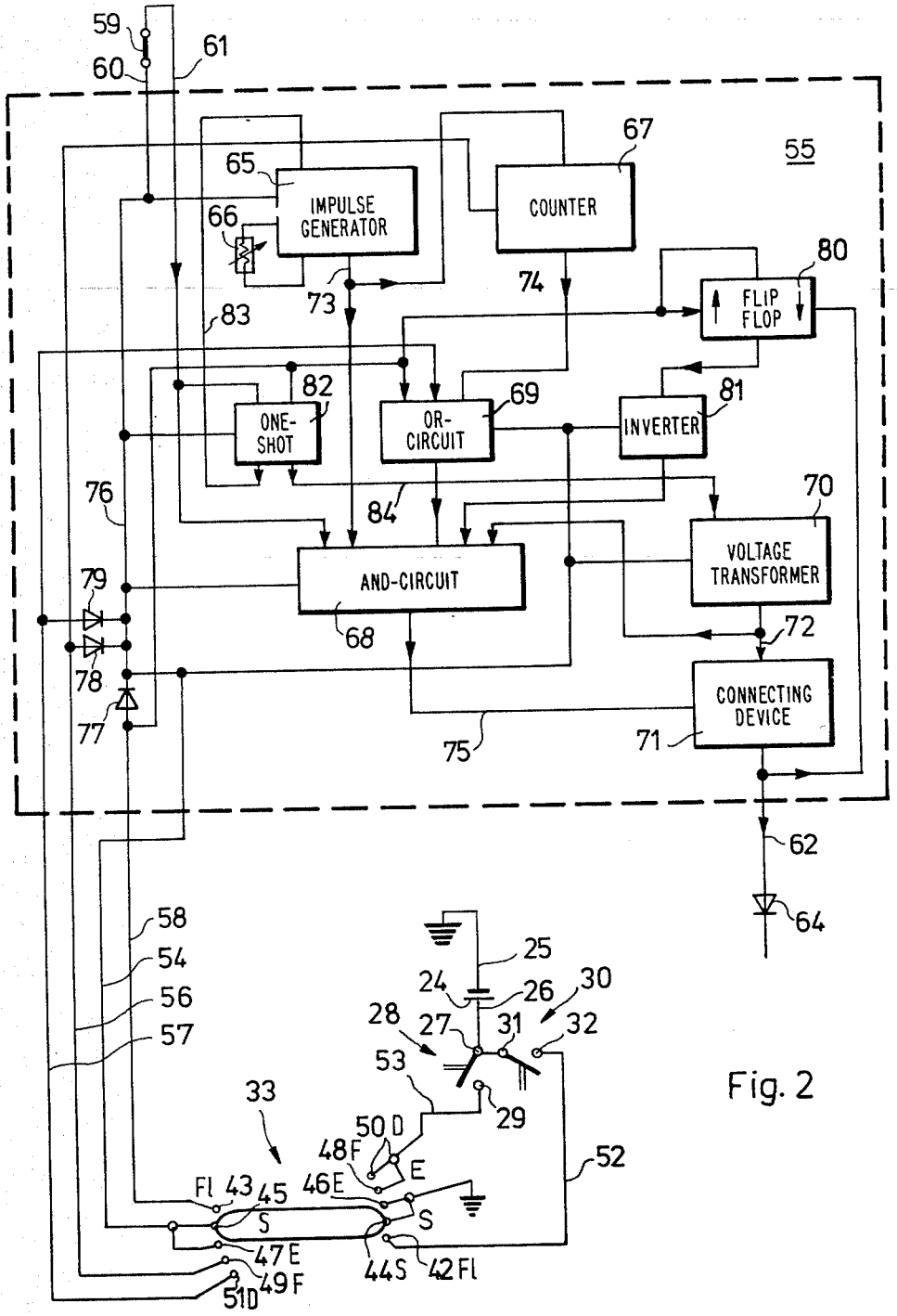
FIG. 2 is a block diagram of the electrical portion of the invention shown in FIG. 1.

In FIG. 2 the details of the electronic circuit 55 and its connections to the firing mode selector 33 and with an OFF contact 59 and the detonator 19 are shown. The electronic circuit 55 comprises an impulse generator 65 such as an astable multivibrator, the frequency of which is adjustable by a rheostat 66. A one-shot multivibrator 82 which activates the impulse generator 65 is provided as well as a voltage transformer 70. A counter 67 which may be permanently set serves as a round counter. The logical connections are carried out by an AND-circuit 68 and an OR-circuit 69. The voltage transformer 70 serves for production of the voltage necessary for firing the detonator 19, by converting the voltage of the battery 24 to the value required for the detonator 19. A connecting device 71, namely a thyristor, is connected to the output of the voltage transformer 70 by way of a line 72 and itself has an output connected to the lead 62 which goes directly to the detonator 19. The output 73 of the impulse generator 65 is connected on the one hand with an input of the AND-circuit 68 and on the other hand with the input of the counter 67. The output of the counter 67 is connected with an input of the OR-circuit by way of line 74. The output of the OR-circuit is connected with a further input of the AND-circuit 68. The lead 57 from selector 33 is connected to another input of the OR-circuit 69, while the third input of the OR-circuit is connected to the line 58. Two additional inputs of the AND-circuit 68 are connected to the output of the voltage transformer 70 and the line 61 from the OFF contact 59. The output of the AND-circuit 68 is connected by way of a line 75 with a corresponding input of the connecting device 71.

The current supply connections for each of the impulse generator 65, the one-shot multivibrator 82, the AND-circuit 68, the OR-circuit 69, the voltage transformer 70 and the inverter 81 lead directly from a power line 76 to which the lead 60 to the OFF contact and the lead 54 to the selector switch 33 are also connected. In addition, the lines 58, 56, and 57 are connected to the power line 76 by way of the diodes 77, 78 and 79 respectively which serve for unidirectional control and separation of uncoupling one line or current from the other.

With the selector 33 in position "sniper" (Fl), the operation of the trigger 1 (pivoting around the pin 2) closes the switch 30 after a short path. Electrical current thereby flows from the battery 24 through the line 52 and line 58 to the individual switching groups of the electronic circuit 55 with the exception of the counter 67. The voltage supplied over the line 58 trips the one shot multivibrator 82, activating simultaneously the impulse generator 65 by way of the line 83 and the voltage transformer 70 by way of the line 84. In addition, a signal reaches the corresponding input of the AND-circuit 68 by way of the OR-circuit 69. If the OFF contact 59 is closed (closed breech block) and if there is a sufficient voltage at the output of the voltage transformer 70, then the next impulse of the impulse generator 65 will input on the AND-circuit, its output whereupon causes the connecting device 71 to emit a detonation impulse to output line 64 resulting in the firing of the round (FIG. 1). To prevent the firing of additional rounds, a flip-flop 80 is provided, whose current feed and adjustment input is connected with the line 58 while its resetting input is connected with the output from the connecting device 71. The output of the flip-flop is connected to an inverter 81 whose output is connected with an input of the AND-circuit 68. At the output of the flip-flop 80, no signal is emitted if it is tripped by the line 58, while a signal is emitted when it is reset by the connecting device 71. The inverter 81 reverses this signal so that at the output of the inverter 81 a signal is always emitted except when a shot is fired in the position "sniper" (Fl) and the flip-flop 80 is tripped by the output to detonation line 62. A signal at the output of the flip-flop 80 can, however, only be emitted when it is connected to the current source by way of the line 58 which is only the case when selector 33 is in the position "sniper".

In the position "safety" (S) the trigger 1 is mechanically blocked by lever 35 and the selector 33 is also grounded to the feed circuit so that a shot cannot be fired in any other way. In the position "semi-automatic" (E) the electronic circuit 55 is similarly connected with ground by way of the line 54 and contact point 46, so that in this instance no round can be fired. However, as seen from FIG. 1 the discharge of a round does ensue through the longitudinal movement of the trigger projection 9 permitted by the elevation of the hooked end 35 from the tab 36. This causes the switch 14 to close, at the beginning of the movement of the trigger 1. Connection is thus made by the line 18 and the impulse line 12 between the piezo voltage generator 10 and the detonator 19. Through the further movement of the trigger, the right angle lever 6 is mechanically tripped releasing the impact piece 5 which is now loaded by the fully compressed spring 4. The impact piece 5 strikes the piezo voltage generator 10 (mode of operation as tension trigger). Immediately an impulse passes from the voltage generator 10 firing the detonator 19.

In the position "burst" (F), the trigger 1 is also movable longitudinally. Here, the switch 28 is closed and the battery 24 is connected with the electronic circuit 55 by way of the line 53 and line 56. The connector 67 is supplied directly with current over line 56 while the other components receive current through the partial feed line 76 supplied by line 56 via the uncoupling diode 78. Once the first round is fired by way of the piezo generator 10, as described above, the movement of the breech block piece 22 first opens the OFF contact 59, so that the one-shot multivibrator 82 receives an impulse by way of line 61. The output signals of the one-shot 82 reaches the impulse generator 65 by way of the pilot line 83 and the voltage transformer 70 by way of the pilot line 84. This causes the impulse generator 65 to be set in operation and the voltage transformer 70 to produce the detonation voltage. When the OFF contact 59 is closed, all inputs with the exception of the input to the AND-circuit 68 from the impulse generator output line 73, are switched on and a round will then be fired each time the impulse generator 65 emits a signal to the AND-circuit 68 and the latter therewith connects with the connecting device 71. With each impulse of the impulse generator 65 the counter 67 counts one stage further until it reaches the preset counter indication selected for the predetermined number of rounds. After having fired the desired number of rounds, the output from the impulse generator to the counter circuit vanishes and the AND-circuit 68 interrupts the further transmission of impulses from the impulse generator 65 to the connecting device 71.

In the position "sustained fire" (D), movement of the trigger 1 closes the switch 28 and the electronic circuit 55 is supplied with current by way of the line 57 which passes directly to the OR circuit 69 and indirectly over the uncoupling diodes 79. If the marginal firing conditions (first round fired by the piezo generator 11, OFF-contact 59 closed, voltage present at the output of the voltage transformer 70, and the input of the inverter 81 is without voltage) are fulfilled, then a round will be fired by each impulse of the impulse generator 65 until, by release of the trigger 1 and the associated opening of the switch 28, the electronic circuit 55 is deprived of current.

Figure 3:
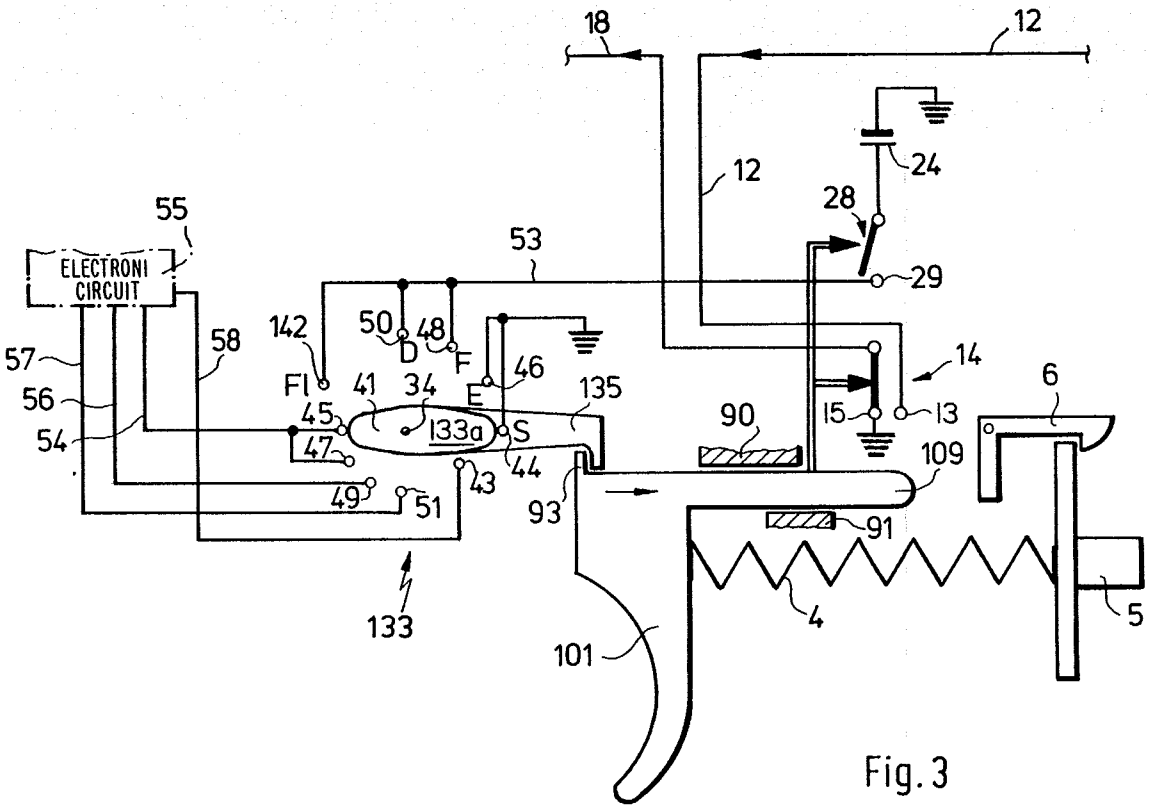
FIG. 3 is a view similar to FIG. 1, showing a further firing mechanism.

FIG. 3 shows a design of a firing mechanism which varies from the type shown in FIG. 1. In FIG. 3 the components which are identical with those shown in FIG. 1 are, for the most part, not illustrated and insofar as the components shown which are fully identical with those of FIG. 1, the same reference signs are used. Those components whose functioning is similar but their arrangement or configuration is different have a reference number increased by 100 than that used in FIG. 1. In the following only the differences from the mechanism shown in FIG. 1 will be dealt with in detail.

In FIG. 3 the firing mode selector lever 133*a* differs from that shown in FIG. 1 in that, starting from the depicted position "safety" (S), it must be turned in a counter-clock-wise direction to the position "sniper" (Fl), whereby the position "sniper" is attained only after the lever 133*a* has passed over the positions "semi-automatic" (E), "burst" (F) and "sustained fire" (D). The switch contact point 43, during firing mode "sniper" (Fl) is connected to switch contact point 142 which is electrically connected with the switch contacts 48 and 50 as well as with the contact point 29 of the switch 28. The switch 30 of FIG. 1 is not provided in the arrangement depicted in FIG. 3. Similarly, the line 52 shown in FIG. 1 is also missing.

The trigger 101 is arranged so as to be capable only of linear motion, in the same direction (arrow A) as in FIG. 1. The trigger is not pivotable and is guided in a slotted groove, formed by two slide ways 90 and 91. The switches 28 and 14, which are also provided in FIG. 1, are operated in the same way in all firing modes, as is the case with the switches 14 and 28 in FIG. 1 with the firing modes "semi-automatic" (E), "burst" (F) and "sustained fire" (D).

The hooked end 135 of the lever 133*a*, as seen in FIG. 3, is similar in its functioning to the hooked end 35, being provided with a depending projection which hooks over an upward tab 93 formed on the trigger 101. This condition is effected in the position "safety" so that the trigger cannot be moved. In all other positions, however, the lever 135 is rotated counter clockwise, disengaging the projection 135 from the tab 93 so that the trigger 101 is movable.

In the firing modes "semi-automatic" (E), "burst" (F) and "sustained fire" (D) the firing mechanism as shown in FIG. 3 operates in the same way as in FIG. 1. In the firing mode "sniper" (Fl), during which the lever 133*a* is turned approximately 150 degrees counter-clockwise, the switches 14 and 28 are activated as in the other firing modes, after a relatively short slide movement of the trigger and while the compression spring 4 is only lightly compressed. The switch 14 is moved so that now the line 12 from the piezo generator is connected with the line 18 to the detonator and the switch 28 is closed so that the current from the battery 24 is now conducted over the line 53. The arrangement is so designed that the switch 14 is initially switched and only shortly thereafter the switch 29 closes. The battery current which is carried via the line 53 to the switch contact 142, when the switch 29 is closed, reaches the contact 43 by way of the conductive portion 41 of the lever 133*a* and from there by way of the line 58, as in the arrangement shown in FIG. 1, to the electronic circuit 55 which thereupon fires a single round.

It is true for both FIGS. 1 and 3 that after the switch 14 has moved and the switch 29 has also closed, further movement of the trigger 1 or 101 in rearward direction would not longer change the positions of the switches 14 and 29. This fact is not evident from the schematic depiction in FIGS. 1 and 3. In actual practice the arrangement is so designed that trip cams (schematically shown in the drawings by the double lines) are provided on the axial projection 9 or 109 from the trigger 1 or 101, so that during the sliding motion of the trigger, they exercise a force upon the movable parts of the switches 14 and 29. The switches 14 and 29 are thus so arranged in proximity to the indicated trip cams that the indicated force basically operates upon the switches 14 or 29 at right angles to the sliding motion of the trigger 1 or 101, and have such a shape that after the switching process, further sliding of the trigger to the rear, does not change the switch positions.

It is to be understood that the invention is not limited to the depicted setup but that variants from it are possible without departing from the concept of the invention. For example, the position "sniper" (Fl) can also be set by a separate mechanical switching lever apart from the firing mode selector lever 33*a* in the arrangement shown in FIG. 1. The counter 67 can also be any adjustable counter in order to change the number of rounds of a burst.

Figure 4A:
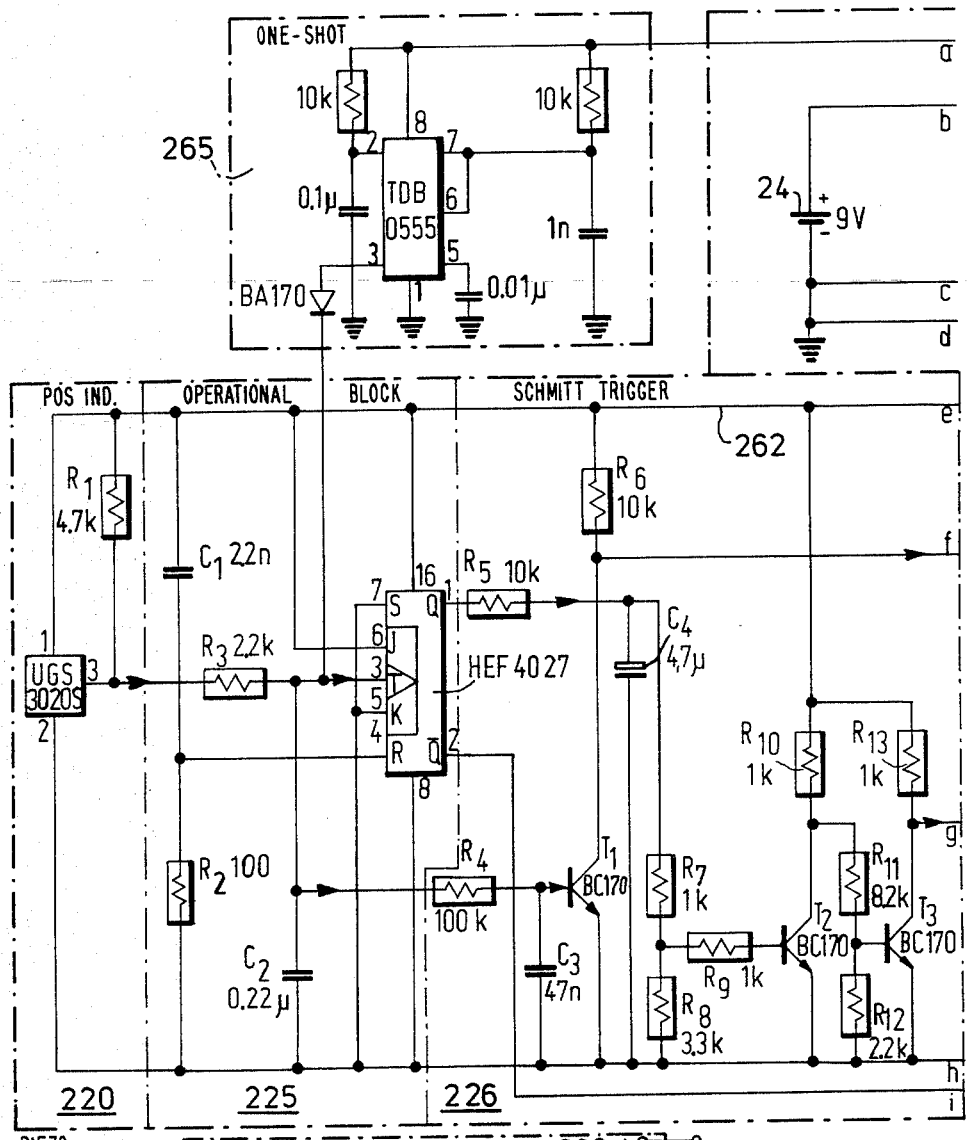
FIG. 4*a* is one half of a circuit diagram of a third firing mechanism.
Figure 4B:
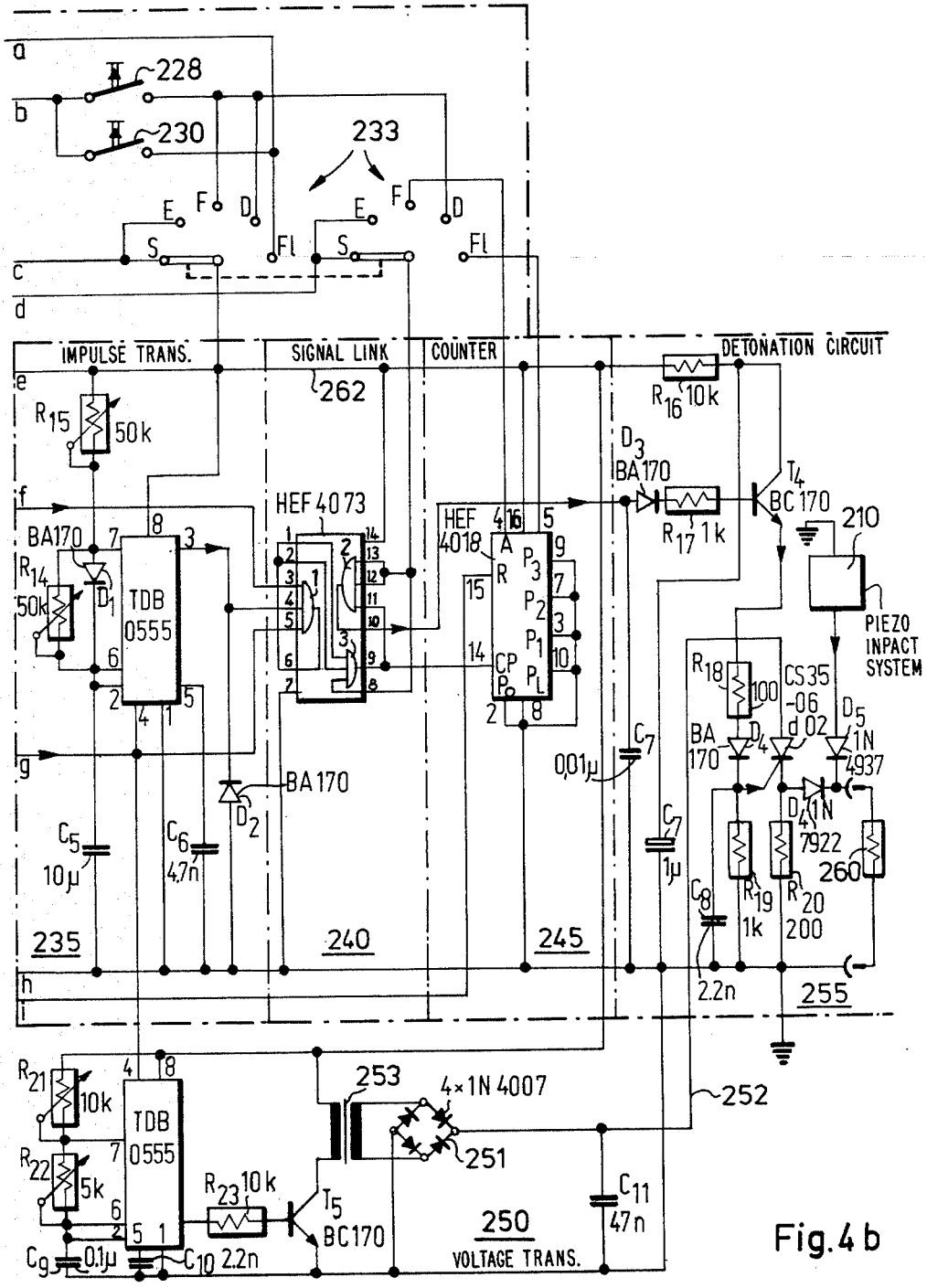
FIG. 4*b* is the second half of the circuit diagram of FIG. 4*a;*

FIGS. 4*a* and 4*b* combine to show a single circuit diagram, wherein the related connections by which the two parts are joined are indicated on the right-hand side of FIG. 4*a* and on the left-hand side of FIG. 4*b* with the letters a to i. This is the complete circuit diagram of an actual design of the invention. The construction components used are indicated on the drawing and do not require further elaboration here. The switch 233 in FIG. 4*b* corresponds basically to the switch 133 in FIG. 3. The piezo generator system 210 is shown in FIG. 4*b* simply in partial cross section.

The circuit of FIGS. 4*a* and 4*b* contains various operational components which are included within broken line blocks and are briefly elaborated in the following text. A remote position indicator 220 contains a Hall-effect element mounted near the breech block, which allows it to determine, through a magnet secured to the breech block, whether the breech block is open or closed. An operational block 225 effects the control as the one-shot of impulse release from the impulse generator. A Schmitt-trigger 226 serves for further processing of the impulses delivered from the operational block 225 which are transferred, somewhat retarded, to an impulse generator 235. From a signal linkage 240 there ensues, after setting of the firing mode selector 233, a path by means of the AND-gate contained in the integrated circuit HEF 4073. A counter 245 assures that in the firing mode "burst" (F) only three rounds will be fired. A voltage transformer circuit 250 converts the voltage from a 9-volt battery so that at the output of the bridge rectifier 251 a positive direct current voltage of approximately 300 volts is obtained. A suitable transformer 253 is one sold by the Neutron Co. of Bremen/West Germany under the designation T 122, "Input Transformer with Transformation Ratio 1:22". This 300 volt output is delivered by way of line 252 to a detonation circuit 255 and there by way of a thyristor to the schematically indicated primer capsule 260 of the ammunition. The electrical energy required for the discharge of the first round (in the firing modes "semi-automatic" (E), "burst" (F) and "sustained fire" (D) is delivered by the piezo generator unit 210 and fed by way of the above mentioned thyristor and a diode D5 to the primer capsule 260 of the ammunition. The diodes D4 and D5 effect a unidirectional control and separation of the two above mentioned sources for the electrical detonation energy.

In the firing modes "burst" or "sustained fire" the positive pole of the battery 24 is connected with the line 262 and thereby supplies the indicated electronics with operational voltage when the trigger is activated by way of the switch 228. Upon further pulling of the trigger, the piezo generator system is released and the voltage created by this means detonates the ammunition. The breech block of the weapon opens and the output voltage of the remote position indicator 220 proceeds from the transmission level L to the level H (at the juncture 3 of the circuit UGS 3020S in the position indicator 220). As a result of this voltage increase there ensues, somewhat retarded, the generation of an impulse by way of the Schmitt-trigger 226. At the same time the detonation impulse for the second shot is generated by the continued feeding of current to the electronic circuit. The breech block of the weapon now closes again and the output voltage of the remote position indicator 220 advances from level H to level L. This voltage increase is inverted and led to the input 3 of the integrated circuit HEF 4073 of the signal linkage 240. The output voltage of the transistor T3 and of the counter at the connection 4 of the integrated circuit HEF 4018 of the counter 245 remains at the level H. The above mentioned signals are linked in the AND-gate 1 of the integrated circuit HEF 4073, so that the ammunition ignites when all inputs of the above mentioned AND-circuit are at the level H. After the third discharge of the ammunition, the voltage at the output of the counter goes from level H to level L. The sequence of shots is therby interrupted.

In the firing mode "sniper" (Fl) an electrical signal of the integrated circuit HEF 4027 (operational block 225) is directed to the impulse release 225 by way of a one-shot Schmitt trigger 265, which simulates the opening and closing of the breech lock. The impulse release output signal of the operational block 225 is further processed in the above mentioned manner in the depicted electronics, wherein, however, the counter 240 counts only a single electrical impulse, so that only a single shot is fired.

A resistor R1 in the remote-position indicator 220 assures that when the breech block is closed, whereby the integrated circuit UGS 3020S determines a magnetic flow, the voltage at the connection 3 of this element has a low reading, namely the reading L. The switch element combinations R3, C2 and R4, C3 supress spurious signals. With the potentiometers R14, R15 and R21, R22 the frequency of the impulse generator or the voltage transformation circuit and the appropriate impulse duration can be set.

Figure 5:
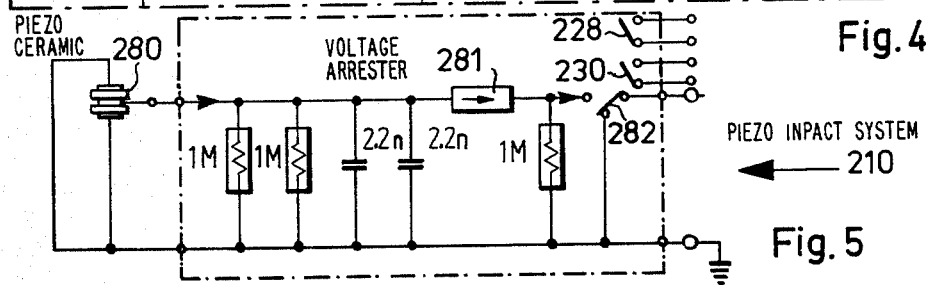
FIG. 5 is the electrical portion of the piezo generator shown in FIG. 4.
Figure 6:
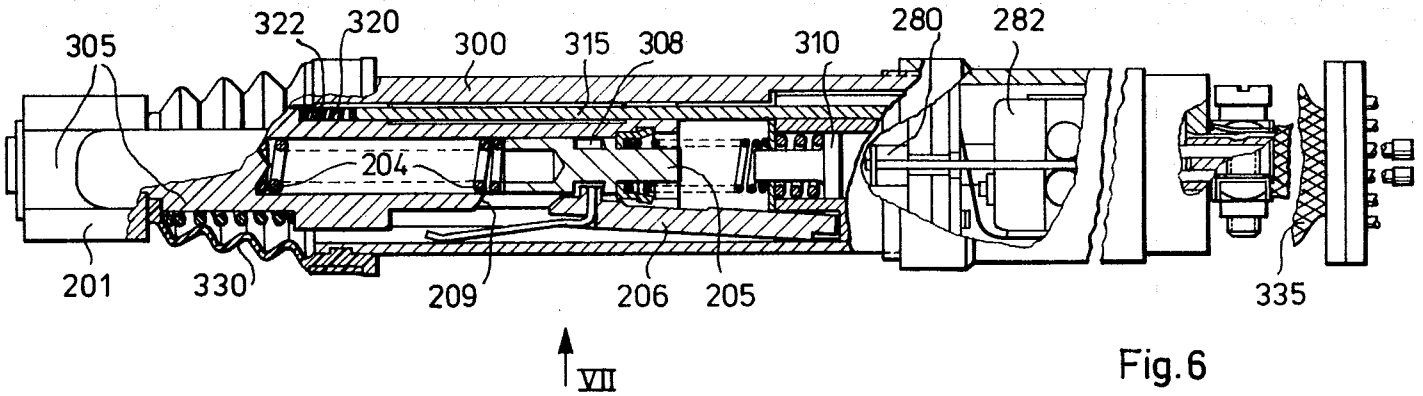
FIG. 6 is the mechanical construction of the piezo impact system shown in FIG. 4.
Figure 7:
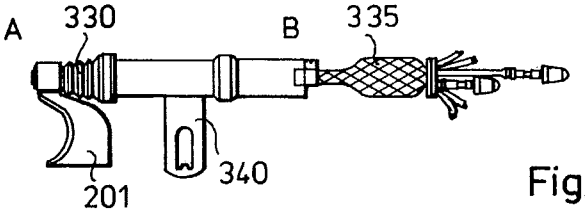
FIG. 7 is a reduced scale elevational view of device shown in FIG. 6 in the direction of the arrow VII.

FIG. 5 shows the electrical circuit employed in the piezo-generator mechanism indicated in FIGS. 6 and 7. A piezoceramic element of the type PXE 21 of the Valvo Co. is shown in the reference number 280, and a voltage arrestor 281 of the type UCH 230 of the Cerberus Co. of Mennedorf-Zurich/Switzerland. The mechanism shown in FIG. 5 contains a total of three microswitches of the type 23SX39-T of the Honeywell Corp. Two of these microswitches form the switches 28 and 30 of FIG. 2. The third switch 282 functions only to short circuit the lines leading to the electronics of FIG. 4 when the trigger is not activated.

The switches 228, 230 and 282 are activated by a pull on the trigger 201 and even after only a short pull on the trigger. The switches 228 and 230 are closed and the switch 282 is switched, thereby creating the connection of the electrical circuit of FIG. 4 with the piezo generator system 210.

The piezo voltage generator shown in its mechanical construction in FIG. 6 has a tubular casing 300, in which a pin 305 connected to the trigger lever 201 is seated so as to move lingitudinally. If the pin 305, upon activation of the trigger 201 in FIG. 6, moves to the right, then it tightens the compression spring 204 which corresponds to the compression spring 4 of FIGS. 1 and 3. An impact piece 205 is thereby at first held fast by a ratchet 206 which engages in the notch 308. If the ratchet 206 is deflected outward by an inclined plane 209 on the pin 305, then the spring 204 flings the impact piece 205 to the right onto an anvil 310 which impacts upon the piezoceramic 280 and thereby effects the release of a voltage impulse by this ceramic 280. The three microswitches 228, 230 and 282 shown in FIG. 5 are arranged in the right end of the casing 300. Only the switch 282 is visible in the opened depiction of FIG. 6. These switches are all activated by a longitudinally movable tappet 315, the left hand end of which is biased by a compression spring 320, which in turn is engaged by a shoulder 322 of the pin 305. If the trigger 201 is moved to the right, then the tappet 315 also moves to the right over the shoulder 322 and the compression spring 320 similarly moves to the right. The microswitches are thus activated after even a brief movement of the trigger 201, i.e. before the retchet 206 is swung out by the inclined plane 209. The compression spring 320 prevents too strong a pressure from being exerted upon the microswitches by the tappet 315.

The infiltration of dirt into the casing 300 is prevented by a gasket 330 in the left portion of FIG. 6. The electrical connections are provided in the right portion of FIG. 6. A wire screen provides an electrical shield and mechanical protection of the electrical connecting circuits.

In FIG. 7 fitting plate 340 is visible, with which the entire mechanism shown in FIG. 6 is mechanically connected with the basic parts of the weapon (not shown). The length of the piezo generator between the points A and B shown in FIG. 7 is 125 mm. The other dimensions can be determined from the drawing scale.

We claim:

1. A firing mechanism for an automatic weapon having explosive charges fired by an electrical detonator receiving electrical energy for firing singular ones of said charges from a piezo voltage generator actuated by a trigger mechanism, means for operating said detonator in other modes such as at least a burst mode and a sustained fire mode wherein said charges are fired repetitively, comprising an additional source of electric energy, switch means connected to the output of said additional source actuatable by said trigger for delivery of electrical energy from said additional source and firing mode selecting means for conducting said delivered electrical energy to said detonator for the second and each successive charge to be fired in said sustained fire and burst modes.

2. The firing mechanism according to claim 1 wherein said trigger mechanism comprises a trigger, an impact member for hitting said piezo voltage generator and a compression spring interposed therebetween, said trigger, impact member and compression spring being arranged so that when said trigger is moved beyond a predetermined distance, said impact member is propelled by said spring into contact with said piezo voltage generator.

3. The firing mechanism according to claim 2 wherein said impact member is removably restrained from movement, and said trigger is movable longitudinally within said predetermined distance to compress said spring against said impact member to load said impact member and on reaching said predetermined distance effect the release of said impact member to permit it to hit said piezo voltage generator.

4. The firing mechanism according to claim 3 wherein said switch means connected to the output of said addition source comprises a relay having a plurality of contacts mechanically operated on movement of said trigger to close prior to release of said impact member.

5. The firing mechanism according to claim 1, wherein said firing mode selecting means includes a safety lever pivotal into a plurality of positions corresponding to the firing modes of said weapon, said lever having means cooperating with said trigger for locking said trigger against movement when placed in one position, and having means for permitting conduction of the electrical energy from the additional source to said detonator in each of the lever positions corresponding to the firing modes.

6. The firing mechanism according to claim 5 wherein said firing mode selecting means includes an electronic circuit having an impulse generator converting said electrical energy from said additional source into repetitive electrical impulses for sequentially actuating said detonator.

7. The firing mechanism according to claim 6 wherein said said electronic circuit includes counter means for limiting the repetitive pulses to a predetermined number.

8. The firing mechanism according to claim 6 including a voltage transformer interposed between said impulse generator and said detonator to increasing the voltage of each pulse.

9. The firing mechanism according to claim 6 wherein the charge is held in a movable breech block, having means for producing a signal indicative of the ready position of said breech block, said signal being fed to said electronic circuit as a pilot signal for operation of said impulse generator.

10. The firing mechanism according to claim 9 wherein said signal producing means includes a mechanical switch movable conjointly with said breech block and being opened on opening of said breech block and being closed on closing of said breech block.

11. The firing mechanism according to claim 5 wherein said means for operating said detonator includes a sniper mode and said switch means is operable to supply current from said additional source without complete compression of said spring and/or release of said impact member, and said lever includes a conductive path to said electronic circuit.

12. The firing mechanism to claim 6 wherein said electronic circuit includes means for limiting the actuation of said detonator to one round with each operation of the trigger.

13. The firing mechanism according to claim 12 wherein said means for limiting said detonation to one round comprises a flip flop and inverter.

14. The firing mechanism according to claim 11 wherein said lever is provided with means for allowing movement of said trigger for a limited distance sufficient to activate said switch means but not sufficient to compress said spring or release said impact member.

15. The firing mechanism according to claim 3 wherein said trigger is pivotal about an axis extending through the longitudinal path of movement of said trigger, and at a point prior to its reaching the predetermined distance, and said switch means are arranged in the path of pivotal movement.

* * * * *